United States Patent [19]

Arcand

[11] Patent Number: 4,806,909

[45] Date of Patent: Feb. 21, 1989

[54] SIMULATED STATIC NOISE GENERATOR

[76] Inventor: Thomas W. Arcand, 11601 Gilmore, #2, North Hollywood, Calif. 91606

[21] Appl. No.: 158,784

[22] Filed: Feb. 22, 1988

[51] Int. Cl.[4] ..... G08B 3/00

[52] U.S. Cl. ..... 340/384 R; 340/407; 446/397; 446/901; 273/DIG. 30

[58] Field of Search ..... 340/384 R, 384 E, 407; 446/397, 420, 901; 273/DIG. 30

[56] References Cited

U.S. PATENT DOCUMENTS

| | | | |
|---|---|---|---|
| 3,018,567 | 1/1962 | Franck | 35/12 |
| 3,173,136 | 3/1965 | Atkinson | 340/384 |
| 3,204,183 | 8/1965 | Hasenzahl | 324/133 |
| 3,412,197 | 11/1968 | Weitzner | 84/103 |
| 3,426,475 | 2/1969 | Foster | 358/305 X |
| 4,034,741 | 7/1977 | Adams | 128/1 |
| 4,335,377 | 6/1982 | Bostic | 340/573 |
| 4,417,207 | 11/1983 | Sato | 324/158 |
| 4,567,806 | 2/1986 | Kodaira | 84/1.26 |
| 4,613,831 | 9/1986 | Loftness | 331/78 |
| 4,755,141 | 6/1988 | Nakai | 446/901 X |
| 4,764,147 | 8/1988 | Baker et al. | 446/397 |

*Primary Examiner*—Joseph A. Orsino
*Assistant Examiner*—Jeffery A. Hofsass
*Attorney, Agent, or Firm*—Don J. Flickinger; Jordan M. Meschkow

[57] ABSTRACT

An apparatus for generating static-like noise comprises a gun shaped plastic housing in which a drive roller and a driven roller are rotatably mounted in rolling engagement with each other. One of the rollers is covered with that portion of a Velcro material comprised of a plurality of flexible hooks while the other roller is covered with that portion of a Velcro material comprising a plurality of flexible loops. Motor means are provided and disposed within the housing for selectively causing the rollers to rotate. In this manner, the Velcro connecting elements continuously engage and disengage. The disengagement of the members produces the desired static-like noise.

12 Claims, 1 Drawing Sheet

SIMULATED STATIC NOISE GENERATOR

BACKGROUND OF THE INVENTION

This invention relates generally to a noise generator, and more particularly to hand held apparatus for generating simulated static noise of the type heard in conjunction with bad telephone connections.

Nearly everyone, at one time or another, has had the desire to terminate an unpleasant, unsolicited, and/or otherwise unrewarding telephone conversation. Often times, however, attempts to end such conversations are unsuccessful due to the persistence of the caller and/or the desire of the called party not to appear rude or impolite. If the party wishing to terminate the conversation had available to them a mechanism for simulating a faulty connection, such party would be provided with an excuse for ending the conversation which would be believable and acceptable to the other party.

The prior art is replete with devices for generating noise signals. Exemplary are U.S. Pat. Nos. 3,018,567; 4,417,207; and 4,613,831. U.S. Pat. No. 3,018,567 discloses an audio frequency static and noise generator intended to acclimate a student pilot to the type of noise which may be encountered in listening to an aircraft radio receiver. The disclosed device not only simulates background noise, but also intermittent static bursts and the like. U.S. Pat. No. 4,417,207 discloses means for simulating electrical noise on a power line, and U.S. Pat. No. 4,613,831 discloses an apparatus for simulating various RF, ultrasonic, and audio frequency noises as an aid in establishing the type of noise to be tracked down in a given environment.

Unfortunately, such devices are not suitable for solving the above described problem in that they are complex, expensive, and would be difficult to use for the intended purpose of simulating a bad telephone connection.

SUMMARY OF THE INVENTION

It is an object of the present invention to provide an improved noise generator for simulating a faulty telephone connection.

It is a further object of the present invention to provide a noise generator for simulating a faulty telephone connection which is easily manufacturable from low cost materials.

It is a still a further object of the present invention to provide a noise generator for simulating a faulty telephone connection which is simple to operate.

According to a broad aspect of the invention there is provided an apparatus for generating static-like noise comprising a housing, a drive roller rotatably mounted in the housing, the drive roller having a major surface, and a driven roller rotatably mounted in the housing in rolling engagement with the drive roller, the driven roller also having a major surface. Means are provided within the housing for imparting rotation to the drive roller in a first direction thus causing the driven roller to rotate in an opposite direction. A first plurality of flexible male connection members are disposed on the major surface of either the drive or driven roller while a second plurality of flexible female connection members are disposed on the major surface of the other of the drive or driven rollers. As the drive and driven rollers rotate, the connecting members continuously engage and disengage. It is the disengagement of the connection members which produces the static-like noise.

The above and other objects, features and advantages of the present invention will be more clearly understood from the following detailed description of preferred embodiments taken in conjunction with the drawings in which:

BRIEF DESCRIPTION OF THE PREFERRED EMBODIMENT

Figure 1:
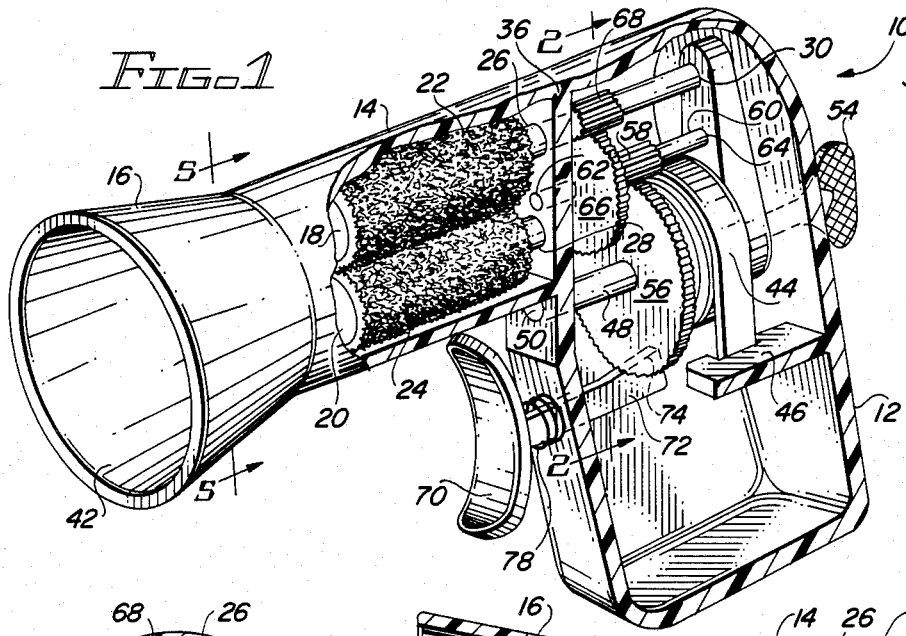
FIG. 1 is a partial cutaway view of the inventive static noise generator.

FIGS. 1, 2, 3 and 4 illustrate a first embodiment of the inventive apparatus. In each of the views, like elements are denoted by like reference numerals As can be seen, the apparatus comprises a generally gun shaped housing 10 (e.g. plastic) comprising a hollow handle portion 12 and a generally cylindrical barrel portion 14 having a terminus 16 in the form of a section of a cone. Coupled for rotation within barrel portion 14 are first and second rollers 18 and 20 which are positioned for rolling engagement with each other. Roller 18 is a drive roller and is rotated by a motor assembly housed in handle portion 12 as will be described hereinbelow. Thus, as drive roller 18 is rotated by the motor assembly in a first direction, driven roller 20 is caused to rotate in an opposite direction due to its engagement with drive roller 18.

Drive roller 18 has disposed on its major surface a plurality of flexible male conductors 22 in the form of hooks, while driven roller 20 has disposed on its major surface a plurality of flexible female connectors 24 in the form of loops. This hook/loop connecting arrangement is commonly referred to as Velcro ®. It should be appreciated that the male connection members could be disposed on the surface of driven roller 20 while the female connection loops are disposed on the surface of drive roller 18.

Figure 5:
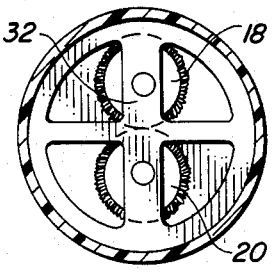
FIG. 5 is a cross-sectional view of the apparatus shown in FIG. 1 taken along line 5—5.
Figure 2:
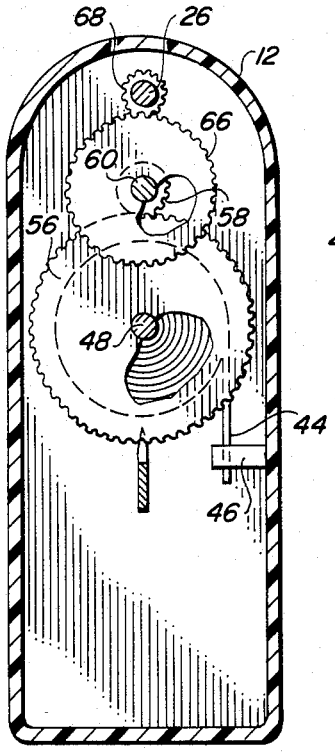
FIG. 2 is a cross-sectional view of the noise generator shown in FIG. 1 taken along line 2—2.
Figure 3:
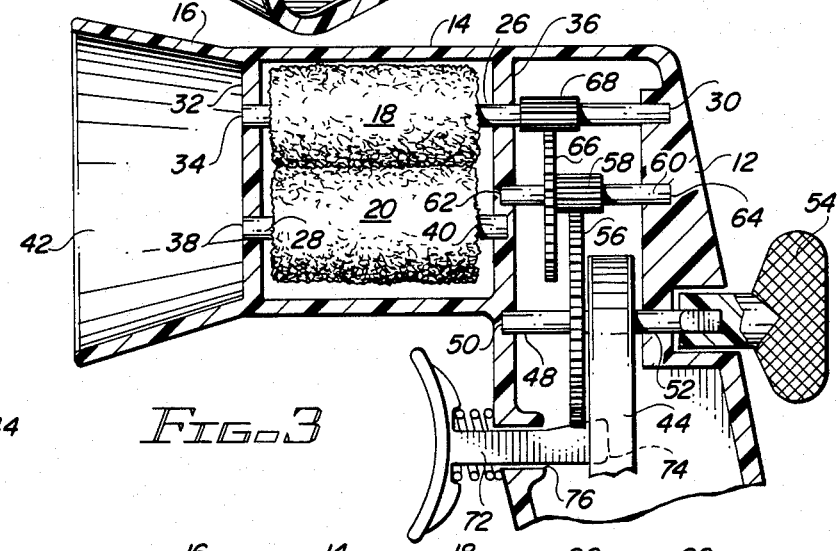
FIG. 3 is a side cross-sectional view of the apparatus shown in FIG. 1.
Figure 4:
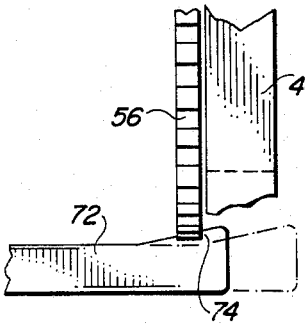
FIG. 4 illustrates in more detail the locking mechanism shown in FIG. 3.

Referring to FIGS. 1, 3 and 5, it can be seen that drive roller 18 is fixedly mounted on axle member 26, and driven roller 20 is fixedly mounted on axle member 28. Axle member 26 is mounted for rotation in handle portion 12 at 30 and in cross member 32 at 34 and passes through wall 36 which separates handle portion 12 from barrel portion 14. Axle member 28 is mounted for rotation in cross member 32 at 38 and in wall 36 at 40. As drive roller 18 rotates in a first direction causing driven roller 20 to rotate in an opposite direction, the male and female flexible connecting members continuously engage and disengage in the region of contact between rollers 18 and 20. It is this repeated disengagement of flexible connection members which produces the desired static-like noise. By placing opening 42 of terminus 16 in close proximity to the mouthpiece of a telephone handset, the simulated static-like noise may be directed into the mouthpiece.

Positioned within handle portion 12 of housing 10 is a wind-up motor of the well known type. It comprises a spring 44 having a first end thereof restrained by restraining member 46. A central shaft 48 is mounted for rotation at 50 and 52 in handle portion 12 to which is fixedly coupled a wind-up key 54 which is accessible from the exterior of housing 10. A first gear 56 is fixedly coupled to shaft 48. Gear 56 engages gear 58 fixedly coupled to gear post 60 which is in turn mounted for rotation in housing 10 at 62 and 64. Gear 66 is also fixedly coupled to gear post 60 and engages gear 68 fixedly mounted on axle 26.

Thus, assuming spring 44 has been wound via winding key 54, and assuming it is free to rotate, the rotation of shaft 48 will be transmitted via gears 56, 58, 66, and 68 to axle 26 thus causing drive roller 18 to rotate.

The apparatus shown in FIGS. 1–5 includes a spring biased trigger mechanism including a trigger 70 and trigger post 72 having an upwardly extending terminal portion 74. Trigger post 72 passes through the handle portion 12 of housing 10 at 76. A spring 78 biases trigger post 72 and trigger 70 such that raised portion 74 normally resides within one of the grooves of gear 56 as is shown by the dotted lines of FIG. 4. In this position, gear 56 is prevented from turning and thus no rotary motion is imparted to drive roller 18. As trigger 70 is manually urged against the force of spring 78 thus compressing spring 78, raised portion 74 of trigger post 72 is disengaged from gear 56 and moves to the rear thereof, thus permitting gear 56 to turn under the force of spring 44 ultimately causing driver roller 18 to rotate.

Figure 6:
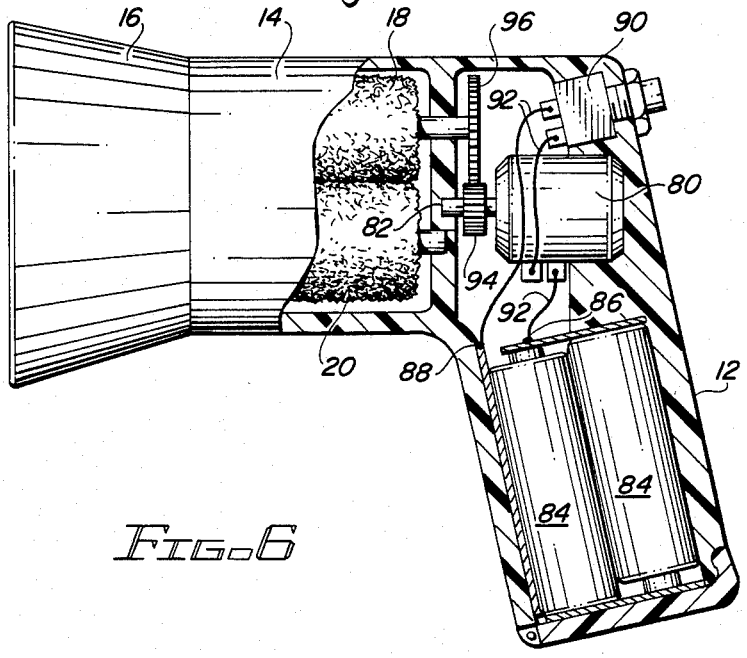
FIG. 6 is a partial cutaway view of an alternative embodiment of the inventive static noise generator.

FIG. 6 illustrates an alternate arrangement for providing rotation to drive roller 18. In this case, an electric motor 80 having a central shaft 82 is mounted within handle portion 12 of housing 10. Also disposed within the housing are batteries 84 having positive and negative terminals 86 and 88 respectively. A switch 90 (in this case a push button switch) is also positioned within handle portion 12 and is accessible from the exterior of handle portion 12. A plurality of wires 92 electrically couples switch 90, motor 80 and batteries 84 in the well known manner. That is, switch 90 when in a first position will result in an open circuit in which case motor 80 is not energized. In a second position however, switch 90 will close a circuit between motor 80 and batteries 84 thus causing shaft 82 and gear 94 fixedly coupled thereto to rotate. This rotation is transferred to gear 96 which is fixedly coupled to the axle of drive roller 18.

Thus there has been provided an apparatus which is easy to manufacture and simple to use and which provides static-like noise for the purpose of simulating a bad telephone connection.

The above is given by way of example only. Changes in form and details may be made by one skilled in the art without departing from the scope of the invention as defined by the appended claims.

I claim:

1. An apparatus for generating static-like noise, comprising:

a housing;

a drive roller rotatably mounted in said housing, said drive roller having a major surface;

a driven roller rotatably mounted in said housing and in rolling engagement with said drive roller, said driven roller having a major surface;

first means mounted in said housing and coupled to said drive roller for imparting rotation to said drive roller in a first direction causing said driven roller to rotate in an opposite direction;

a first plurality of flexible male connection members disposed on the major surface of one of said drive and driven rollers; and a second plurality of flexible female connection members disposed on the major surface of the other of said drive and driven rollers, said first and second plurality of members continuously engaging and disengaging as said drive and driven rollers turn to produce said static-like noise.

2. An apparatus according to claim 1 wherein said first means comprises:

a motor coupled to said drive roller; and switch means coupled to said motor and accessible from the exterior of said housing for selectively activating and disabling said motor.

3. An apparatus according to claim 2 wherein said motor is an electric motor.

4. An apparatus according to claim 2 wherein said motor is a wind-up motor.

5. An apparatus according to claim 4 further comprising wind-up means accessible from the exterior of said housing for winding-up said wind-up motor.

6. An apparatus according to claim 3 further comprising power supply means disposed within said housing and coupled to said electric motor for supplying current to said electric motor.

7. An apparatus according to claim 6 wherein said power supply means comprises at least one battery.

8. An apparatus according to claim 6 wherein said switch comprises a push button switch coupled between said power supply means and said electric motor.

9. An apparatus according to claim 5 wherein said switch comprises trigger means capable of being manipulated from a first position which prevents rotation of said drive roller to a second position which permits said drive roller to be rotated by said wind-up motor.

10. An apparatus according to claim 9 wherein said trigger means is spring biased so as to be normally in said first position.

11. An apparatus according to claim 2 wherein said housing is gun shaped.

12. An apparatus according to claim 11 wherein said housing comprises:

a generally hollow handle portion for housing said motor means; and a barrel portion coupled to said handle portion and having an opening at one end thereof, said barrel portion for housing said drive roller and said driven roller.

* * * * *